US007258296B2

(12) United States Patent
Smith et al.

(10) Patent No.: US 7,258,296 B2
(45) Date of Patent: Aug. 21, 2007

(54) SPIRAL WINDER AND A METHOD OF SPIRALLY WINDING

(75) Inventors: Martin James Smith, Dorset (GB); Franklin George Strong, Blackburn (GB); Duncan Parkinson, Rishton (GB)

(73) Assignee: Luvata Oy, Espoo (FI)

( * ) Notice: Subject to any disclaimer, the term of this patent is extended or adjusted under 35 U.S.C. 154(b) by 252 days.

(21) Appl. No.: 10/250,874

(22) PCT Filed: Dec. 21, 2001

(86) PCT No.: PCT/GB01/05761

§ 371 (c)(1),
(2), (4) Date: Jan. 14, 2004

(87) PCT Pub. No.: WO02/055228

PCT Pub. Date: Jul. 18, 2002

(65) Prior Publication Data

US 2004/0118960 A1 Jun. 24, 2004

(30) Foreign Application Priority Data

Jan. 10, 2001 (WO) ..... PCT/GB01/00091

(51) Int. Cl.
*B21C 47/10* (2006.01)

(52) U.S. Cl. ..... 242/361; 72/66; 72/135

(58) Field of Classification Search ..... 242/361, 242/361.4; 72/66, 135
See application file for complete search history.

(56) References Cited

U.S. PATENT DOCUMENTS 1,557,424 A * 10/1925 Conant ..... 242/578

FOREIGN PATENT DOCUMENTS

| | | | |
|---|---|---|---|
| FR | 2574058 | * | 6/1986 |
| JP | 59-86560 | * | 5/1984 |
| JP | 59085319 | * | 5/1984 |

* cited by examiner

*Primary Examiner*—John Q. Nguyen
(74) *Attorney, Agent, or Firm*—Fay Sharpe LLP

(57) ABSTRACT

A spiral winder is disclosed adapted to implement a new method for spirally winding a product of indefinite length, such as pipe, into a coil for packaging and/or transport to an end user. The spiral winder consists primarily of a rotor assembly (1) supporting a caster (7) such that product fed along the rotary axis to the caster (7) as the rotor (1) rotates is guided to the outlet from the caster to be deposited onto a pallet in the form of a planar spiral. By vertically indexing the pallet and reversing a radial motion of the caster outlet layers of planar spirals can be produced as a self supporting coil without the necessity of any internal mandrel or external retaining drum. By careful control of the stresses in the product as it passes to and from the caster (7) fragile product such as thin walled heat exchanger pipe can be coiled rapidly.

35 Claims, 17 Drawing Sheets

SPIRAL WINDER AND A METHOD OF SPIRALLY WINDING

The present invention is concerned with a new spiral winder apparatus particularly adapted to implement a new method of spirally winding a pipe like product into a coil for transport elsewhere. The spiral winder and method are particularly useful in the production of coils of pipe.

This description of the invention and prior art will commonly refer to the product as pipe because the spiral winder was invented particularly for the purpose of winding seamed thin gauge aluminium or copper pipe. However, for most purposes pipe should be understood to mean any elongate product of indefinite length which it is convenient to package as a coil; for example, pipe of any material including seamless pipe, cable, rope or wire.

Conventionally pipe has been formed by rolling a strip of metal such as aluminium or copper until the long edges meet. The edges are then welded or soldered together and the pipe may then be subject to various finishing processes such as polishing. After quality control sampling and testing the pipe is sent to a coiler where it is wound to form a coil. Conventional coilers wind the pipe helically onto a mandrel, thus the lead end of the pipe is fed into a notch in the mandrel to trap it, the cylindrical mandrel is rotated at a speed corresponding to the feed rate of the pipe and a traveller simultaneously displaces the feed pipe along the axis of the mandrel at a rate such that each loop of the pipe lies closely adjacent the former loop forming an annular layer. The traveller reverses at the axial end of the pipe to lay another annular layer on top of the preceding layer. The conventional coiling process is subject to a number of problems including starting the coil on the mandrel by feeding the pipe into the notch which results in waste pipe.

When the coil is completed the mandrel is reduced and removed from the bore of the coil. The coil so formed is then transported onto a pallet or other platform for packaging, or in the case of pipe, annealing, required due to the work hardening which takes place as the pipe formed, rolled and coiled. Because the mandrel is required there is a significant delay and labour in discharging a completed coil from the coiler to a pallet. Consequently pipe is either wasted or expensive accumulators are required to accommodate the delay as the pipe production process continues upstream. Helically coiling the pipe has the effect of amplifying any faults in the loops of coil laid in underlying layers as the layers are laid on top. In extreme cases this effect may result in damage to the pipe, particularly during subsequent process steps such as annealing or at end use as the pipe is unwound from the coil.

Annealing takes place by passing the coil of pipe through an elongate oven for a prolonged period. Heating occasionally results in spot welding or soldering of one loop of pipe where it touches another loop. This can cause serious problems when the coil is unwound and result in waste. The annealing oven has a very large heat capacity and it is therefore not economic to allow it to cool between production runs. Conversely, there is a significant unwanted overhead and ecological disadvantage to providing power to keep the annealing oven hot at all times.

It is conventional to unwind helically wound coils from the core, along the axis, by pulling the pipe axially. This tends to result in damage as a consequence of binding which may occur between the layer of pipe being unwound and the overlying layer.

The spiral winder of the present invention and the process of spiral winding aim to alleviate the technical problems exhibited by the prior art coiling apparatus and method and to provide apparatus for manufacturing spirally wound pipe and a method of manufacturing a spirally wound coil of pipe.

Accordingly there is provided a spiral winder for spirally winding a coil of pipe comprising a spiral winder for spirally winding a coil of pipe comprising a rotor assembly supported to rotate about a vertical axis and having a caster adapted to receive the pipe into an inlet and to support and guide the pipe to an outlet and a traverse assembly to support said outlet to travel in a spiral orbit in a spiral plane about the axis whereby the pipe can be inducted into a caster inlet and induced to travel through the caster to the outlet where it can be discharged in the spiral plane onto a platform in a planar spiral pattern.

It should be appreciated that in the context of the invention the term "spiral" refers to a spiral lying in a plane and not a helix, i.e., a coil lying in a hollow cylindrical surface. The term "spiral orbit" refers to the spiral path followed by the caster outlet around the main axis, i.e., the path from any given starting point until the outlet returns to the starting point.

In practice the caster will usually be a helical duct having the inlet vertical and on the axis of rotation of the rotor. The caster serves to guide the pipe from the inlet to the outlet and also to protect the pipe from damage. Bearing in mind that one particular application of the spiral winder is to coil thin walled pipe, such pipe is vulnerable to damage from buckling and kinking. The duct is preferably provided by a continuous tube of a resilient material able to support its own weight and that of the pipe passing through it. However, the caster may be provided by an articulated tube or an open channel. In some instances the caster may comprise little more than supports to support the pipe at distributed locations between the caster inlet and outlet to prevent the pipe collapsing under its own weight. Where the caster comprises a chute, the chute may fan out to the outlet.

The radial motion of the caster outlet is preferably provided by a traverse assembly of the rotor rotatably supported on a main shaft to support the outlet of the caster. The traverse assembly includes a track extending radially from the main shaft to guide a carriage for carrying the caster outlet radially in and out. A carriage propulsion mechanism is provided whereby the radial speed and direction of travel of the carriage can be controlled in response to signals from a control system. The control system will basically control the carriage speed and direction in accordance with the speed of rotation of the caster and the radial position of the carriage so that the carriage moves at one pitch per rotation. However the carriage radial speed may be reduced to zero for one rotation at the inner or outer locus of the spiral so that a climbing loop of pipe can be laid to start a new overlying spiral layer.

A support assembly is provided to support the rotor and the platform whereby the distance between the spiral plane and the platform can be increased so that when a first layer of pipe has been laid on the platform and the caster outlet reaches the inner or outer locus of the spiral a next layer of the pipe can be laid onto a former layer of the pipe. Although it is possible to move either or both the rotor and the platform, it is preferable to keep the rotor assembly and hence the spiral plane stationary and to move the platform down away from the spiral plane. To achieve this a lift assembly is installed to extend beneath the spiral plane. Preferably the lift assembly is a fork lift assembly so that the platform can be provided by a conventional pallet. In practice it is preferable to initiate the next overlying layer by first dropping the platform a height exceeding the depth of the layer which encourages the pipe to climb and as the new layer begins to be established after forming the climbing loop the platform can be slightly raised. The reason for this will become more apparent from the comments below.

Pipe and like materials are somewhat resilient and so tend to try to recover towards a straighter line than is required for tight spiral packing. It is important that each loop of pipe is packed closely against an adjacent layer so that the finished coil occupies a minimal volume, and the pipe cannot move and be damaged within the coil. To prevent the pipe from moving once it is laid the rotor assembly may be provided with a clamp roller assembly comprising a clamp roller rotatable about a roller axis and mounted so that the roller axis extends radially from and is rotatable around the main axis above the spiral plane so that the periphery of the roller can bear on the pipe as it is laid on the platform. A problem to be addressed by the clamp rollers is to ensure that no compressive or tensile forces are applied to the laid loops of pipe so the roller must rotate over the pipe on which it bears at exactly the same speed as the roller axis rotates about the main axis. It might be possible to achieve this by having a narrow roller traverse with the outlet of the caster, however, this will only secure a single loop of pipe in one position. Several such traversing rollers might be provided angularly spaced but this would still only secure one loop of pipe in a spiral layer. An elongate roller supported to rotate around an axis extending radially suffers the problem of mismatched roller surface speed. This might be resolved by providing a plurality of freely rotating rollers each of a diameter corresponding to one loop of pipe. However the preferred solution is to provide the roller with a conic rolling surface configured so that the roller surface speed at any given radius from the main shaft axis matches the roller traverse speed at which the axis of the roller at that radius traverses the platform at that radius from the main shaft axis.

One benefit of making the roller conic is that the roller can be driven in rotation about its axis. Normally the drive is controlled by the control system in response to the position rotary and radial speed of the caster outlet so that the surface speed of the roller exactly matches the speed at which the roller axis traverses the pipe and no force is applied in the axial direction of the pipe. However, in some circumstances it may be desirable for the rollers to apply small carefully controlled forces to the pipe by implementing a small difference between the roller surface speed and the roller axis traverse speed.

Particularly where fragile products such as thin gauge pipe are being coiled it is preferable that the surface of the roller is provided by a resiliently deformable material to disperse the vertical load of the roller pressing on the pipe. With the object of further alleviating the risk of the weight of the roller assembly damaging the pipe, and to allow the roller assembly to accommodate pipe of various diameter, the roller assembly may be mounted onto the main shaft to be vertically displaceable with respect to the main shaft, preferably by means of a resilient suspension. This arrangement explains why the aforementioned motion of the platform is desirable as the initial large movement separates the laid coils from the rollers sufficiently to allow a gap for the establishment of a new layer before the platform is brought towards the spiral plane so that the new forming loops of pipe are engaged by the roller.

A problem arises with the formation of the climbing loop at the outermost locus of the coil caused by the tendency of the climbing loop to expand. As a consequence of this tendency the climbing loop does not have adjacent inner loops of pipe to naturally bind against and so tends to fall down the outside of the layers of the coil. A preferred solution to this problem is to provide each roller assembly with a peripheral retaining pulley supported to engage the outermost climbing loop of the pipe as the distance of the platform from the spiral plane is increased. The pulley is a grooved wheel supported with its axis inclined to the horizontal. The climbing loop of pipe engages in the groove of the wheel and is supported at least until the first outer loop of the overlying pipe layer is established.

To ensure that all the loops of a spiral layer are securely retained it is preferable that five angularly spaced roller assemblies are provided.

It is important that the tension or compression in each spiral of pipe laid is carefully controlled, usually this will require that little or no tension or compression is present in the pipe as it is laid into the coil. Any tension or compression present in the coil as it is laid is likely to result in the loop of pipe moving to relieve the tensile or compressive forces. A preferred solution to this problem is to feed the pipe to the caster inlet via a capstan assembly. The capstan assembly comprises an assembly of pulleys and or belts of which at least some are motorised. The speed of the capstan is controlled via the control system in response to the speed of the rotor assembly. Most of the time the speed of the capstan is adjusted to correspond to the speed of the pipe laying from the caster head so that there is minimal tension or compression in the pipe which would otherwise result in an unwanted tendency for the laid pipe coils to contract or expand. However, it also allows tension or compression to increased to desired levels when wanted. The capstan also serves to turn the pipe into the caster inlet.

The speed at which pipe is delivered from upstream to the capstan is ordinarily determined by the speed of the pipe producton line. Therefore provision must be made to allow for speed changes at the capstan when the pipe tension or compression is to be varied. This is preferably achieved using an accumulator deployed immediately upstream of the between the capstan.

To allow for rapid exchange of platforms when a coil is completed, a transfer table assembly is provided to transfer an unloaded platform to the lift assembly and simultaneously to transfer a platform loaded with a coil away from the lift assembly.

According to a second aspect of the present invention there is provided a method of spirally winding a pipe comprising the steps of:

inducting a pipe into a caster inlet orbiting an outlet of the caster around the main axis in a spiral pattern lying in a spiral plane in order to discharge the pipe onto a platform in the spiral pattern.

The method of spiral winding provides a further benefit in that when a coil nears completion the pipe is simply cut to form a cut end, the cut end is wound into the coil so that the coil is complete. The coil is then ready for transport to a packaging station where protective packaging may be applied if desired or directly to storage or the customer on the pallet. In practice it is also possible to stack several coils one on top of another using the spiral winder by the simple expedient of laying a separator onto a completed coil so that the coil and separator act as a new platform and winding another coil onto the separator. This way self supporting stacks of several coils can be wound onto one pallet.

According to a third aspect of the present invention there is provided apparatus for manufacturing a spirally wound coil of pipe comprising:

apparatus for forming a pipe of indefinite length, apparatus for transporting the pipe in the direction of its length, apparatus for annealing the pipe as it is transported, a spiral winder for spirally winding the annealed pipe into a coil.

According to a fourth aspect of the present invention there is provided a process for manufacturing a spirally wound coil of pipe comprising the steps of:

forming a pipe of indefinite length while the pipe is transported in the direction of its length, annealing the pipe as it is transported, coiling the annealed pipe in a spiral winding apparatus directly onto a pallet.

By virtue of the third and fourth aspects of the present invention the pipe can be annealed before it is coiled so alleviating the problems with the coils of pipe welding or soldering together exhibited by the prior art system.

Embodiments of the spiral winder, a method of spirally winding the pipe apparatus for manufacturing a spirally wound coil of pipe and a process for manufacturing a spirally wound coil of pipe will now be described, by way of example only, with reference to the accompanying illustrative drawings, wherein.

Figure 1:
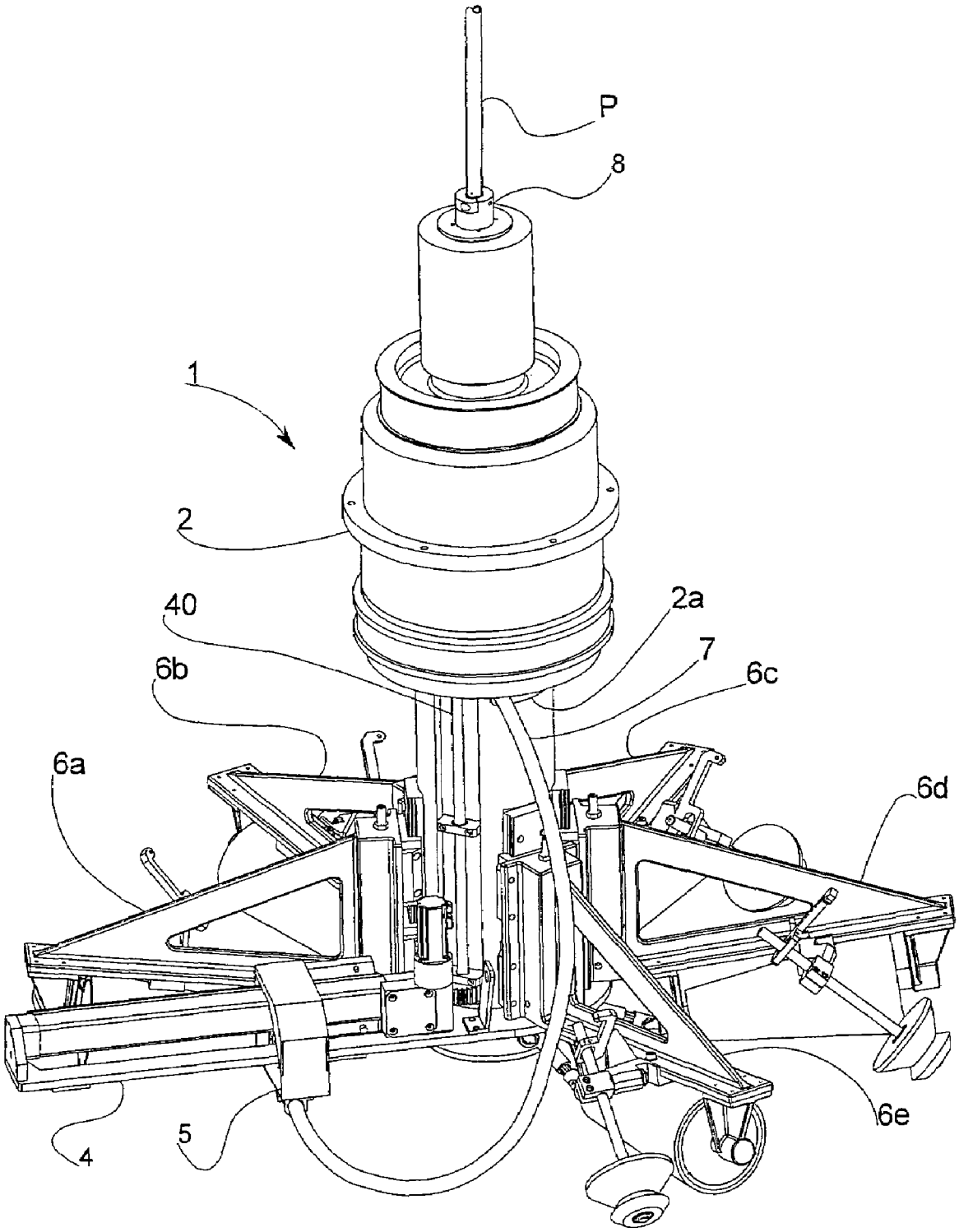
FIG. 1 is a perspective view of a rotor assembly.
Figure 3:
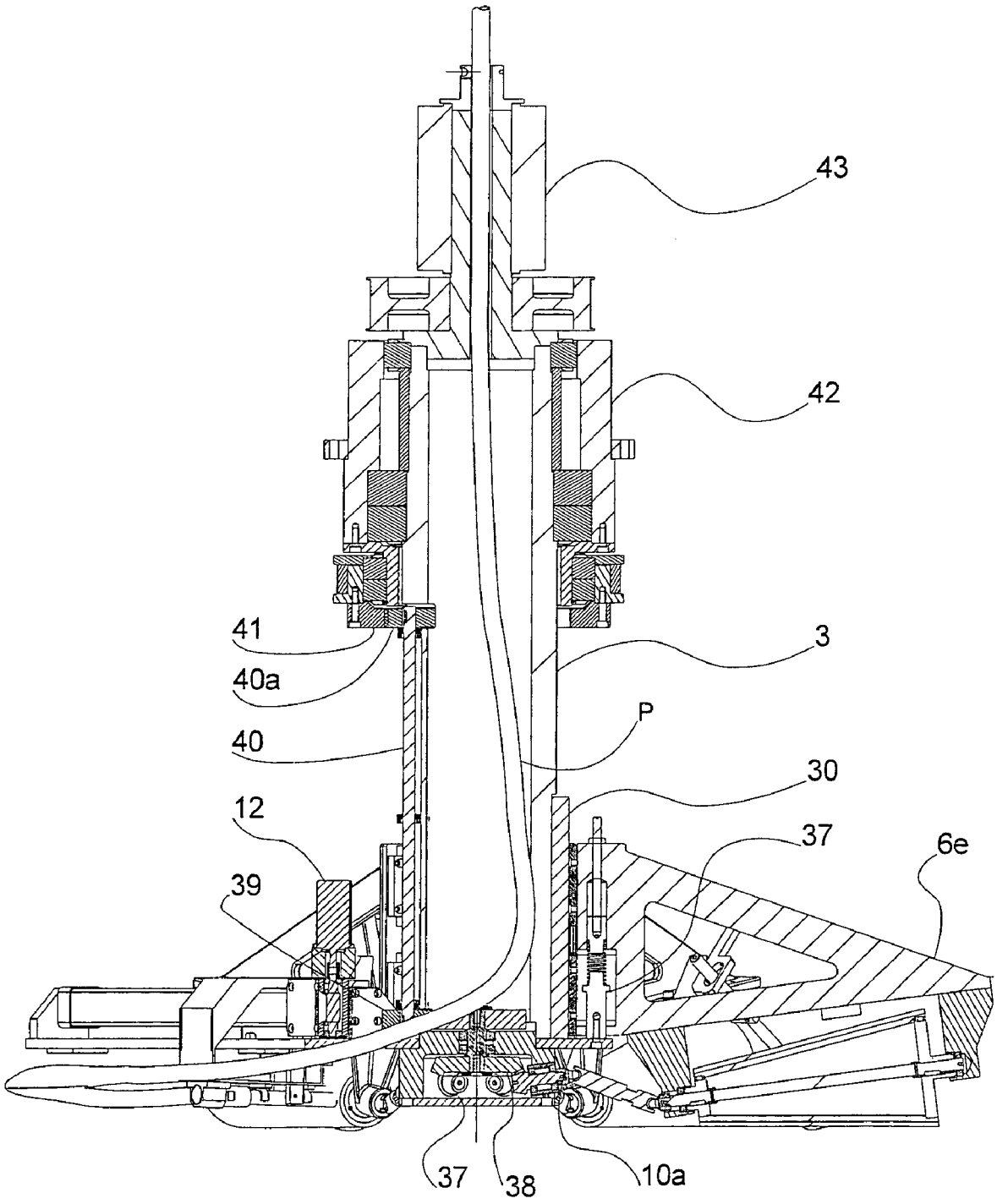
FIG. 3 is a sectional elevation through the rotor assembly
Figure 4:
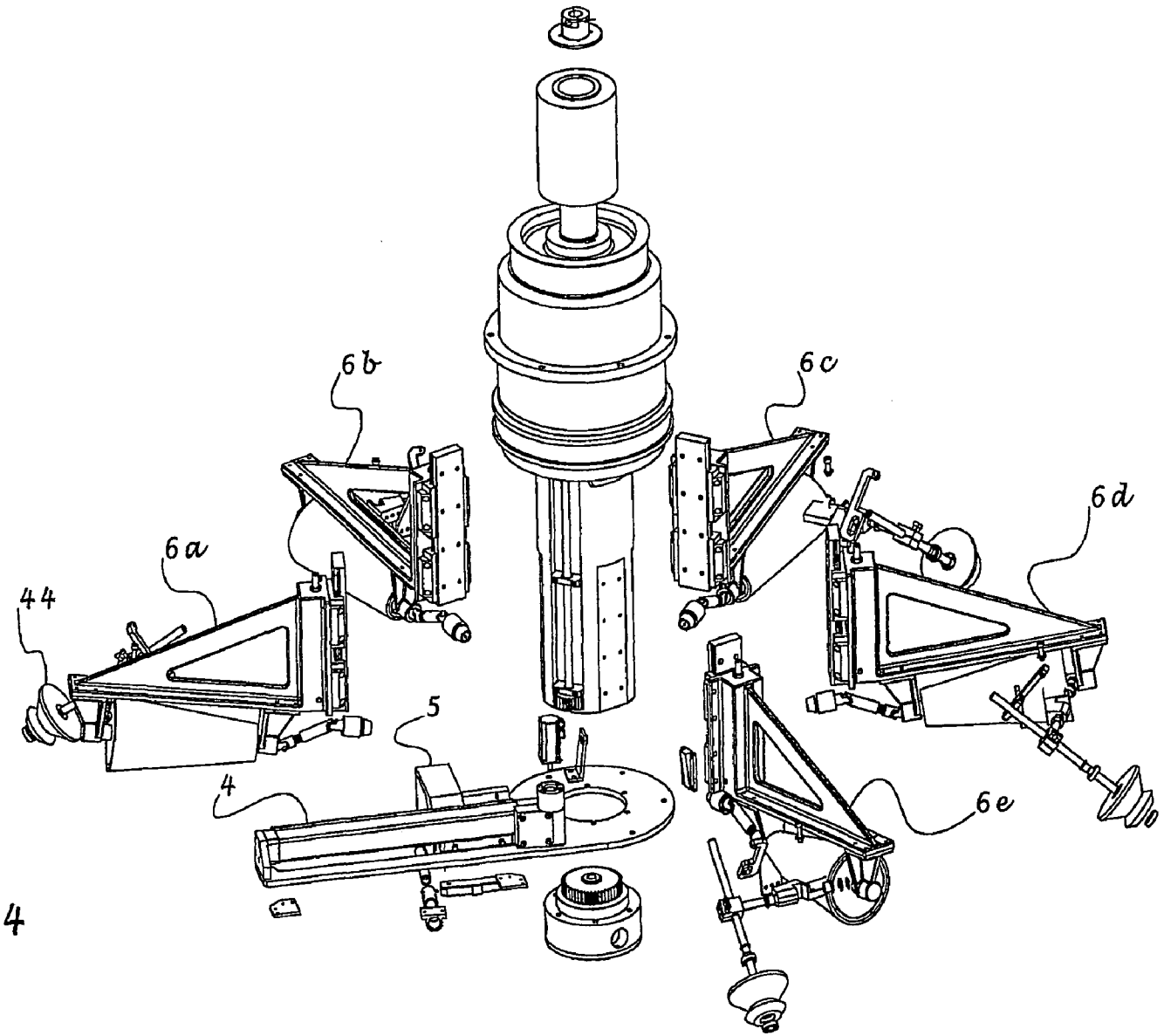
FIG. 4 is an exploded view of the rotor assembly
Figure 5:
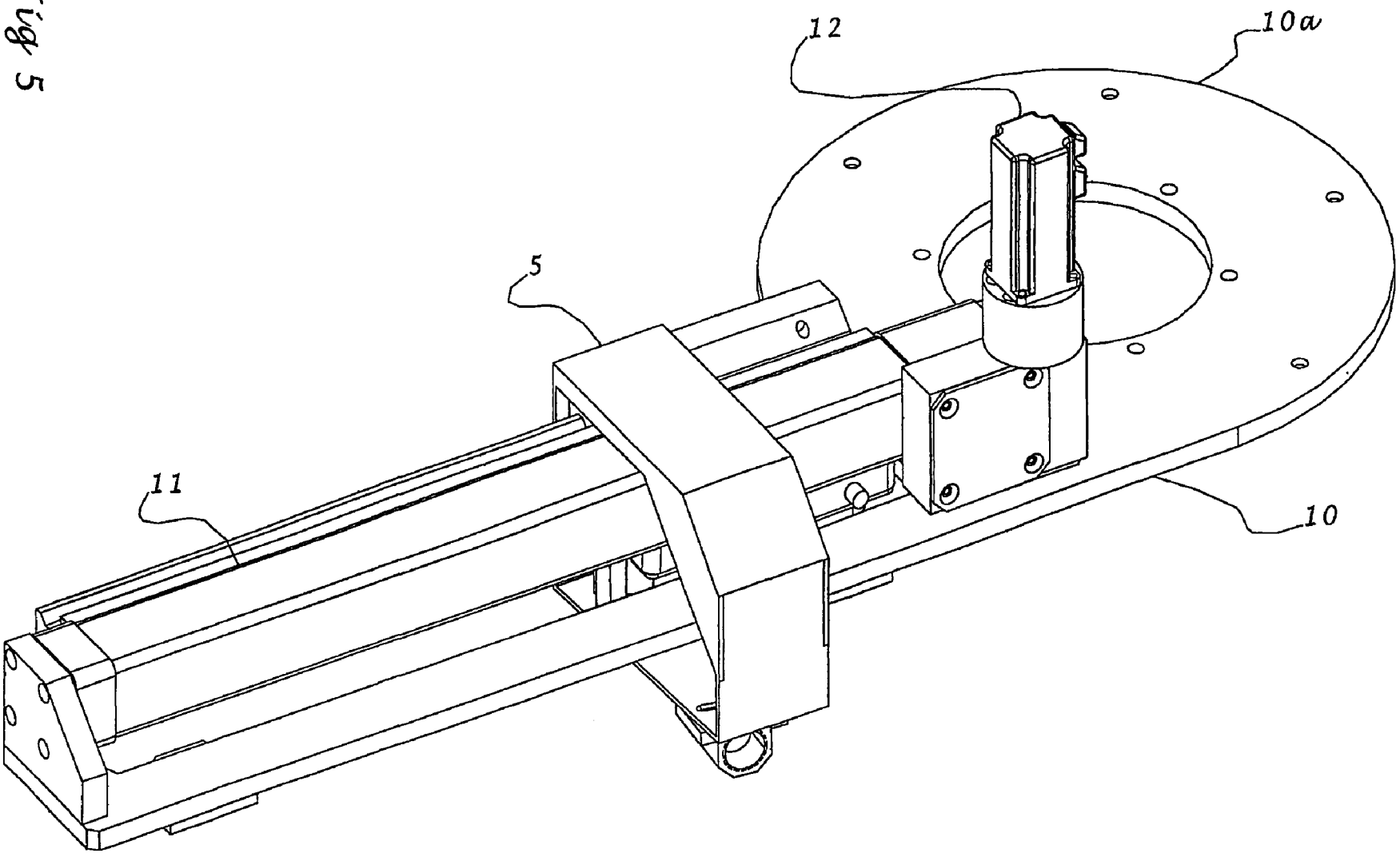
FIG. 5 is an enlarged perspective view of the traverse assembly.
Figure 6:
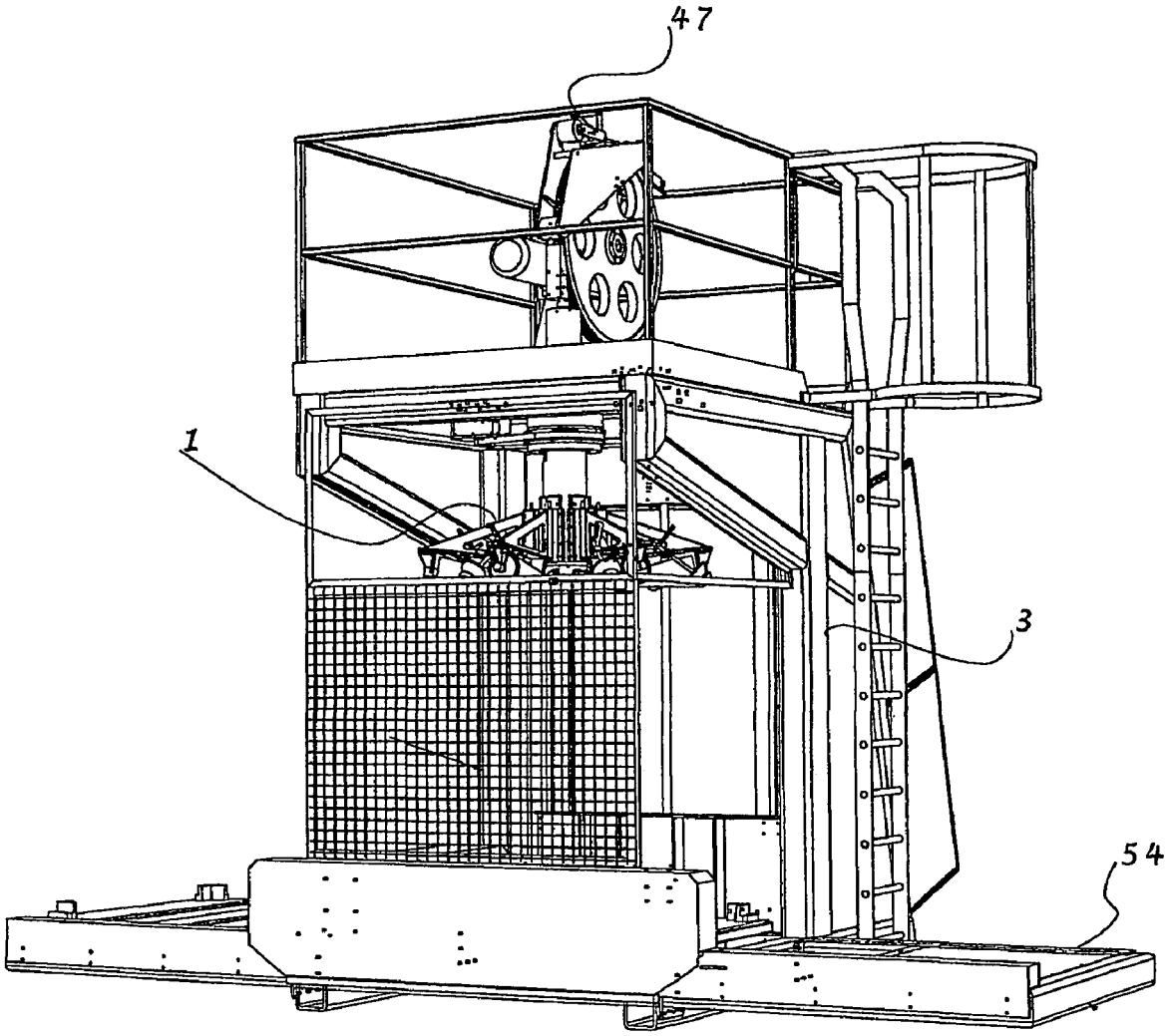
FIG. 6 is a perspective view of the spiral winder from below and in front.
Figure 7:
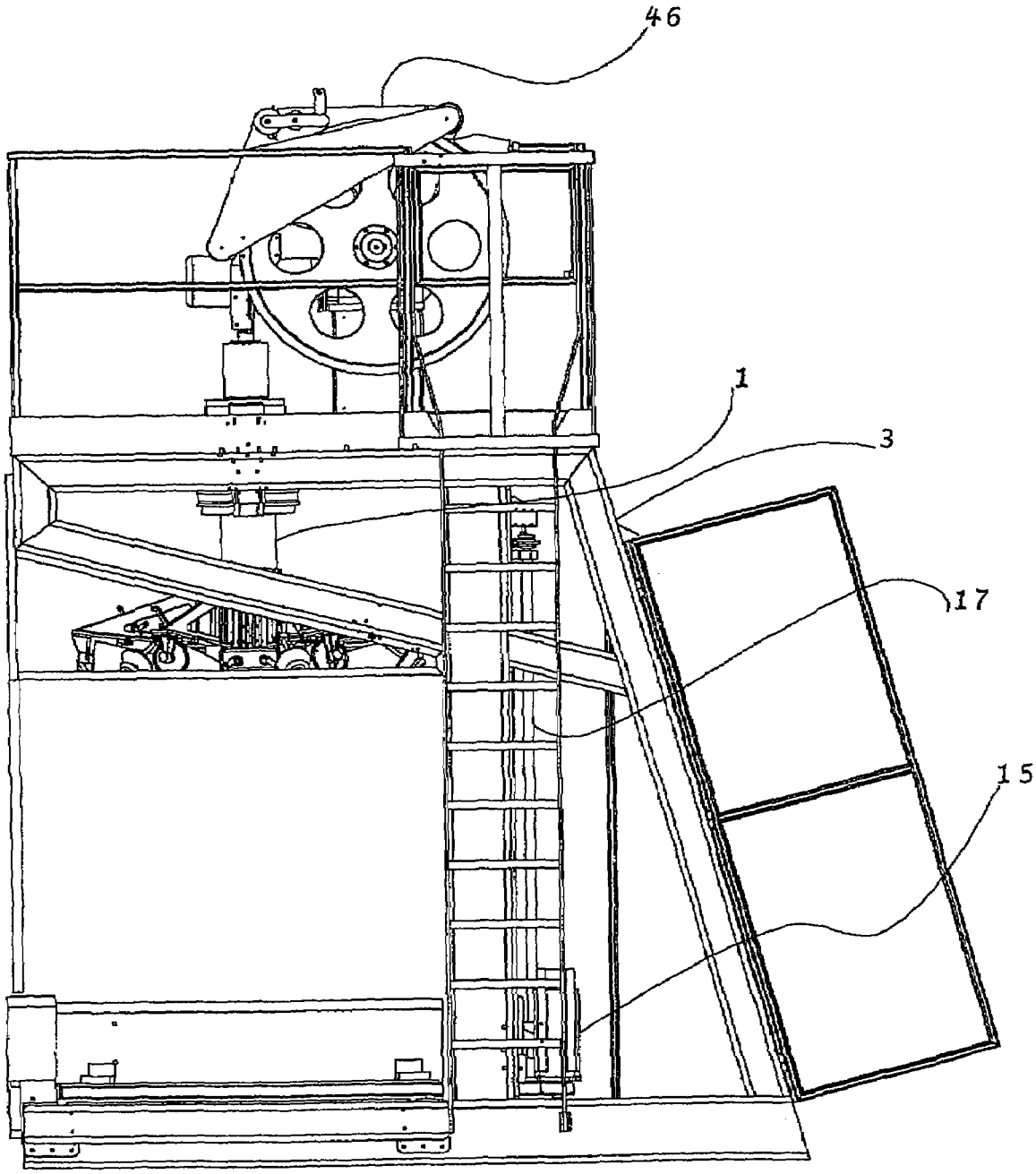
FIG. 7 is side elevation of the spiral winder

Referring to the drawings, FIG. 1 shows a rotor 1 which can be seen in place within the spiral winder shown in FIGS. 6 and 7. The rotor 1 consists of a main shaft 2 supported vertically within the support structure provided by a main frame 3, a traverse assembly 4, which includes a carriage 5, five roller assemblies 6 and a caster 7. The caster 7 comprises an elongate flexible duct provided in this case by a resiliently flexible tube. The caster 7 might also be provided by means of an articulated tube or possibly other devices able to support and guide a flexible pipe from its inlet 8 to a caster outlet 9. The inlet 8 to the caster consists of a port located coaxially in the top of the main shaft 2. As can readily be seen in FIG. 3, the main shaft is hollow so that the caster 7 can pass from the inlet 8 down through the hollow core of the shaft and out through an aperture 2*a* located beneath a bearing assembly of the shaft 2. The caster then spirals helically down to an outlet 9 which is engaged by the carriage 5.

The traverse assembly 4 comprises an elongate rigid support member 10 by means of which it is attached near the base of the main shaft to extend radially. A guide track 11 is supported by the support member 10 and the carriage 5 is mounted onto the track 11. The track includes a motor drive sub-assembly comprising a reversible electric motor 12 coupled to drive a worm drive whereby the carriage can be propelled radially along the track from an inner radius to an outer radius.

Figure 2:
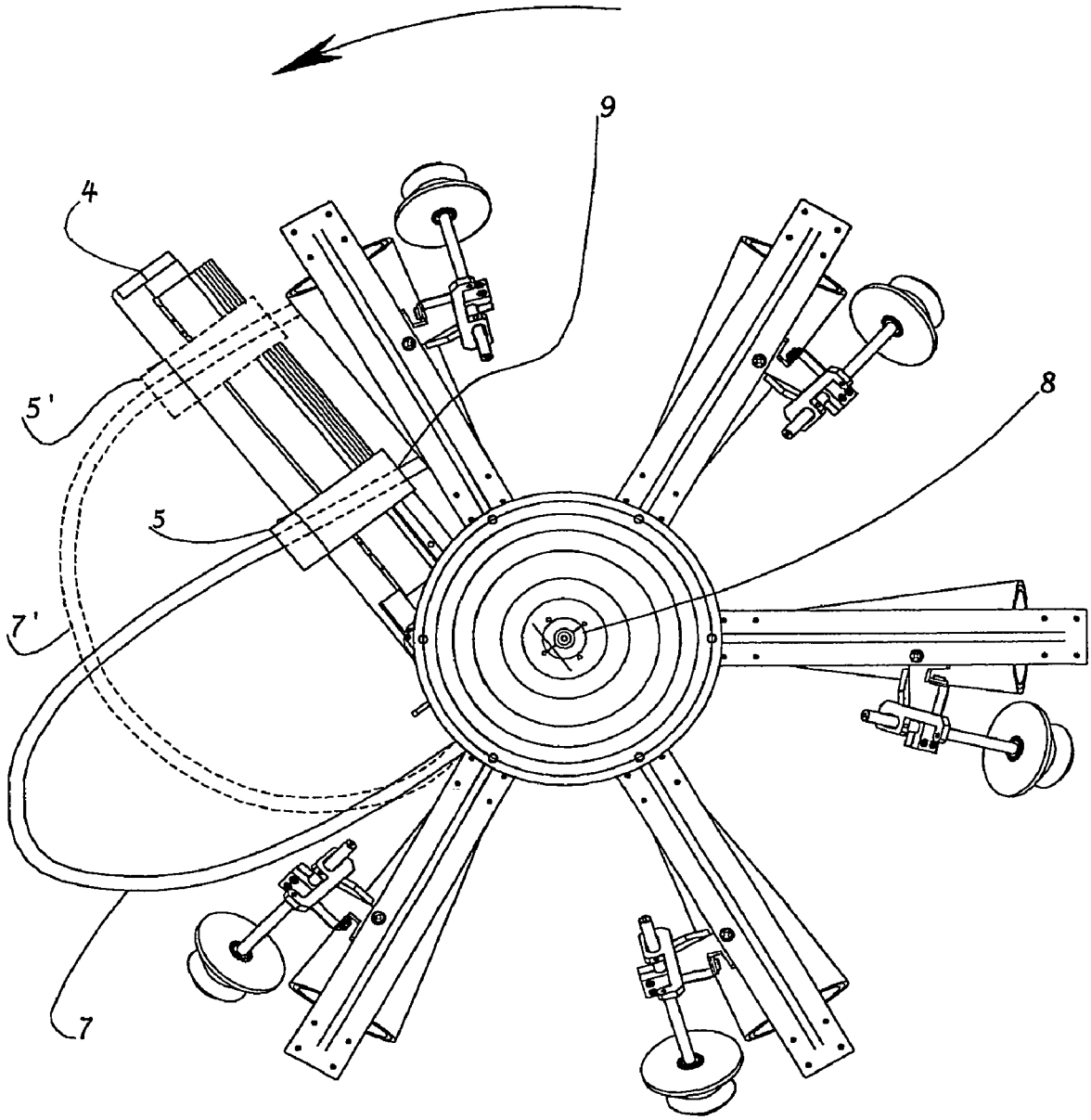
FIG. 2 is a plane view of the rotor assembly.

In operation pipe P is fed into the inlet 8 of the caster and the rotor assembly is rotated via a motor drive (not shown) in the direction of the arrow in FIG. 2 (anticlockwise). The inlet draws the pipe into the caster towards the outlet 9. A control system (not shown) controls the motion of the carriage 5 so that it travels at one pitch of a spiral per revolution towards the inner or outer radius (shown ghosted in FIG. 2). A platform (not shown), preferably a pallet, is supported via a lift assembly below the spiral plane in which the caster outlet 9 rotates. Thus pipe P expelled from the caster falls to the pallet in a spiral pattern.

Figure 8:
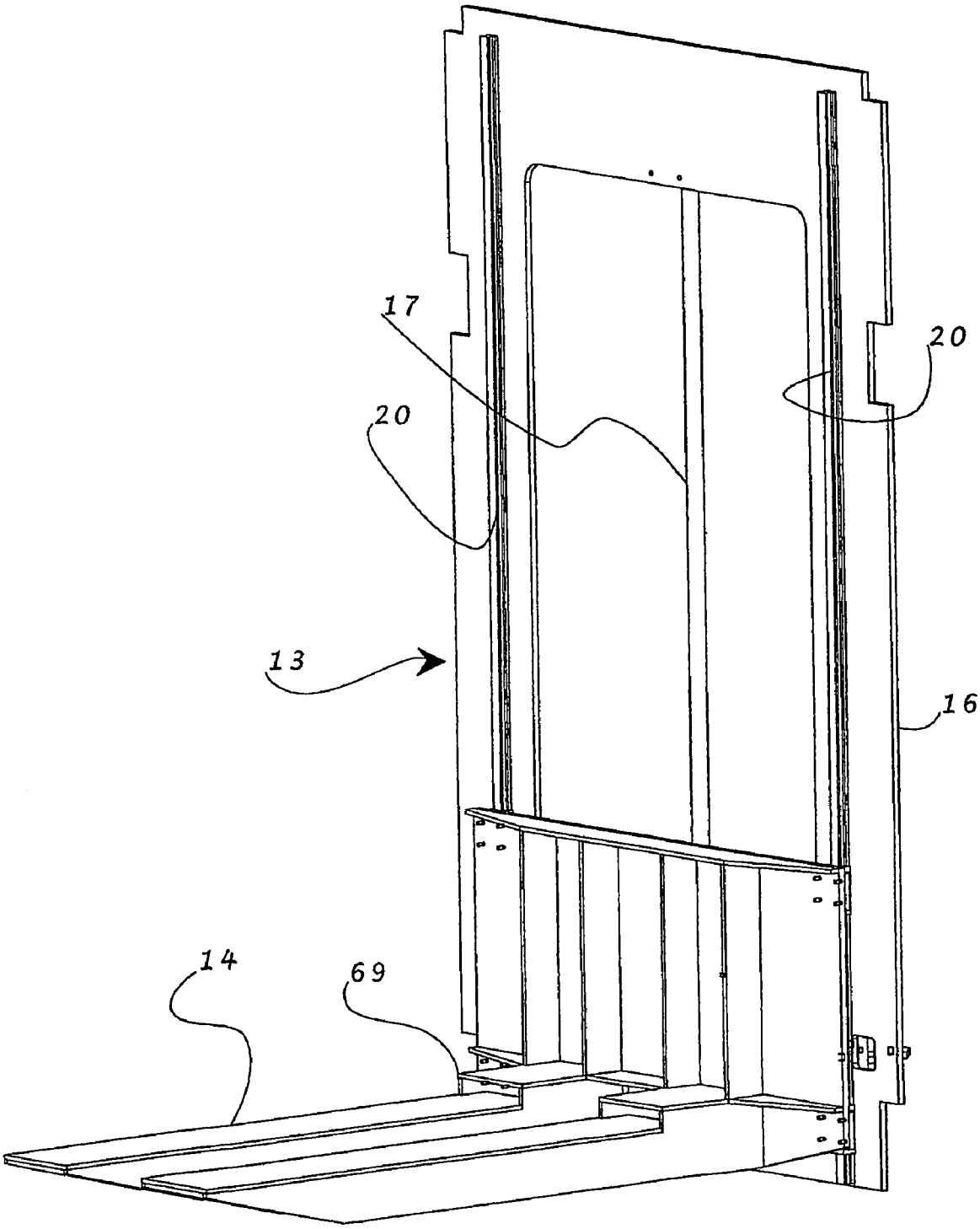
FIG. 8 is a perspective view of a lift assembly from in front
Figure 9:
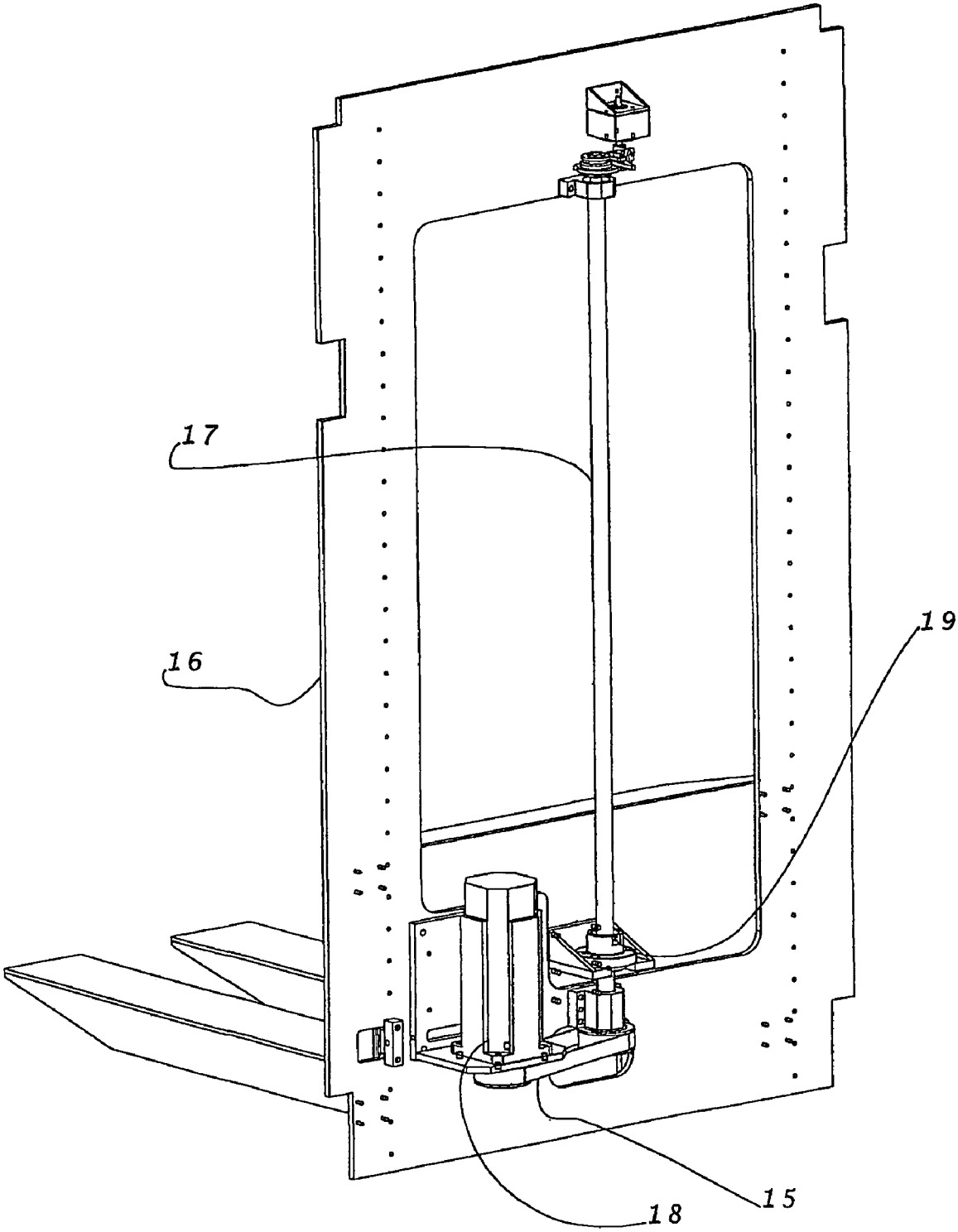
FIG. 9 is a perspective view of the lift assembly from the rear

The rotor 1 is supported in a support assembly provided by the main frame 3 which in this example rests on the ground. The support assembly might also comprise the walls of a pit. The main frame 3 also supports a lift assembly shown enlarged in FIGS. 8 and 9. The main frame supports the rotor 1 so that the spiral plane is in excess of 1.2 m above the floor and in this case closer to two meters above the floor. A lift assembly 13 shown in detail in FIGS. 8 and 9 is installed in a rear part of the main frame 3. The lift assembly 13 provides a fork lift 14 which can be raised and lowered via a lift motor and drive system 15 controlled by a control unit (not shown) of the spiral winder to accurately lift a pallet from the floor to a position underlying the rotor 1 so that pipe can be spirally laid onto the pallet.

The lift assembly comprises a supporting frame 16 adapted to be fastened into the main frame 3 of the spiral winder so that the forks of the fork lift 14 underlie the spiral plane. The drive system 15 consists of a worm drive shaft 17 rotatably driven by an electric lift motor 18. The worm drive shaft engages a follower nut 19 mounted on the rear side of the fork lift 14 and a position sensor (not shown) capable of determining the height of the fork lift and communicating the height to the control unit. A pair of guide rails 20 are provided on the front of the frame to guide the fork lift 14.

The lift assembly is controlled during winding the pipe so that when the loop of pipe being wound reaches a radially innermost or radially outermost position, the height of the pallet is indexed down by slightly more than the diameter of the pipe P. Thus a climbing loop of pipe is formed where the pipe climbs over the layer already laid. The direction of travel is reversed at this time so that the pipe laid begins to spiral back over the layer already laid.

It may here be noted that in some embodiments of the invention it may be more convenient to adapt the apparatus so that the platform is kept stationary and toe rotor displaced up and hence the spiral plane is moved away from the platform to achieve a similar layering effect.

Figure 10:
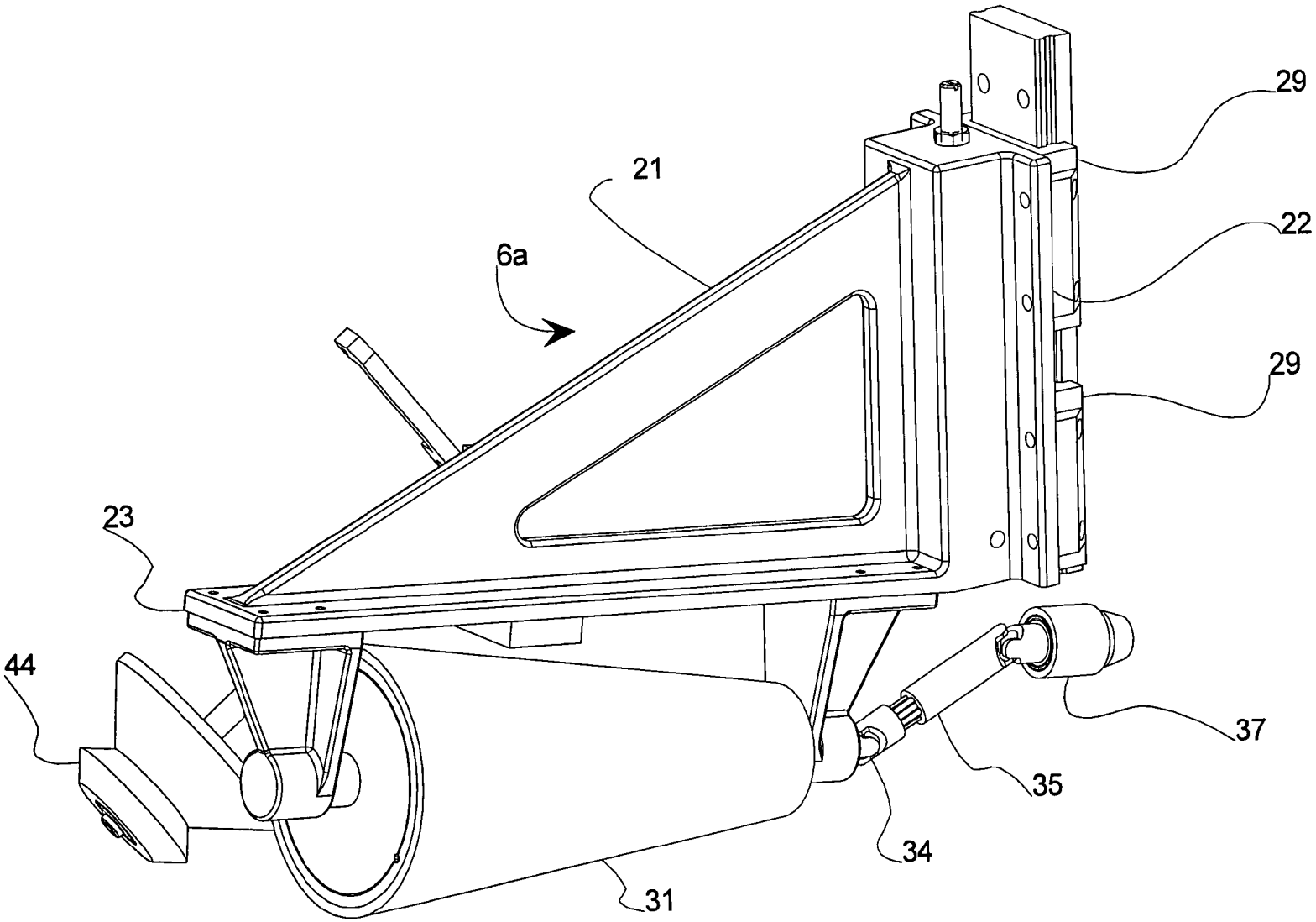
FIG. 10 is an enlarged perspective view of a roller assembly.
Figure 11:
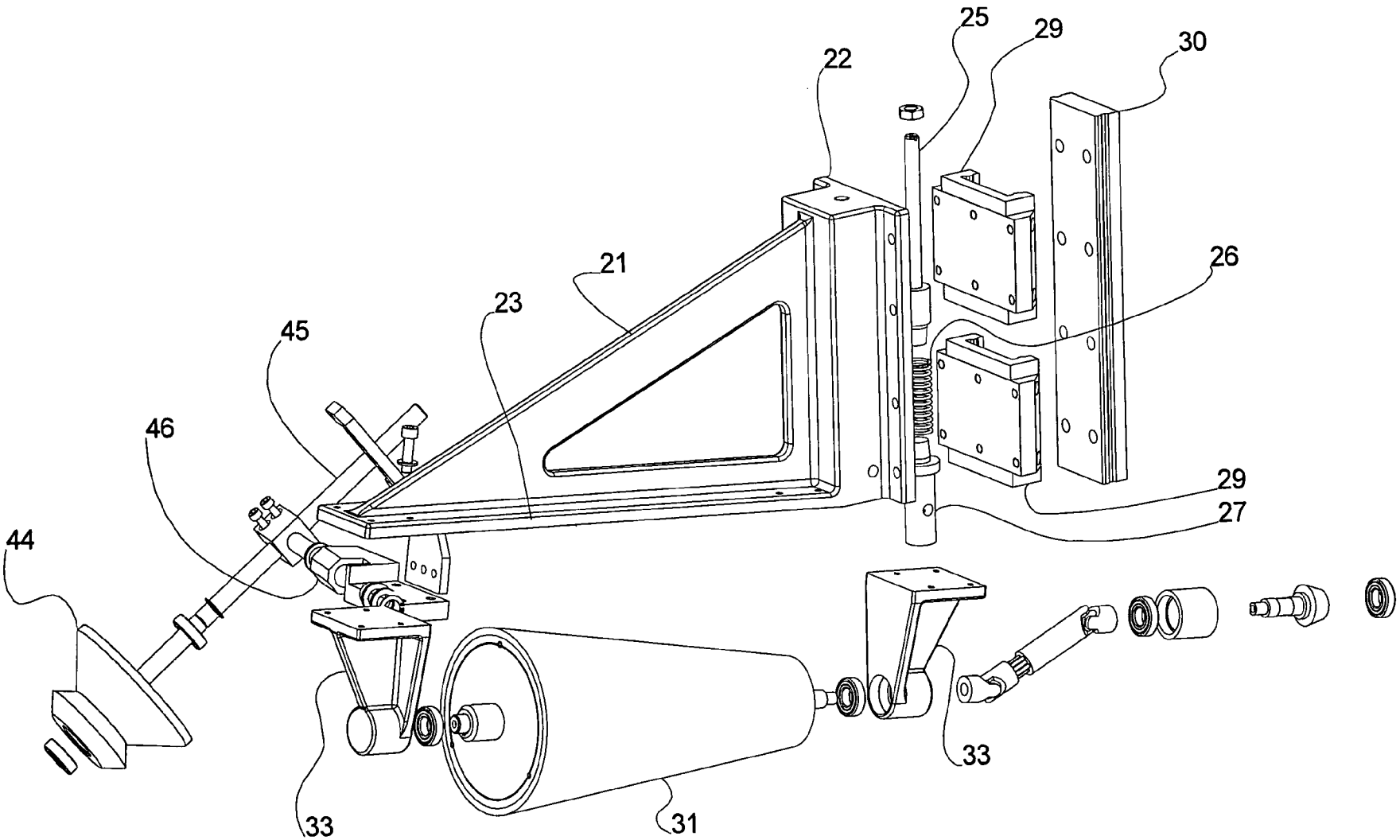
FIG. 11 is an exploded perspective view of the roller assembly.
Figure 12:
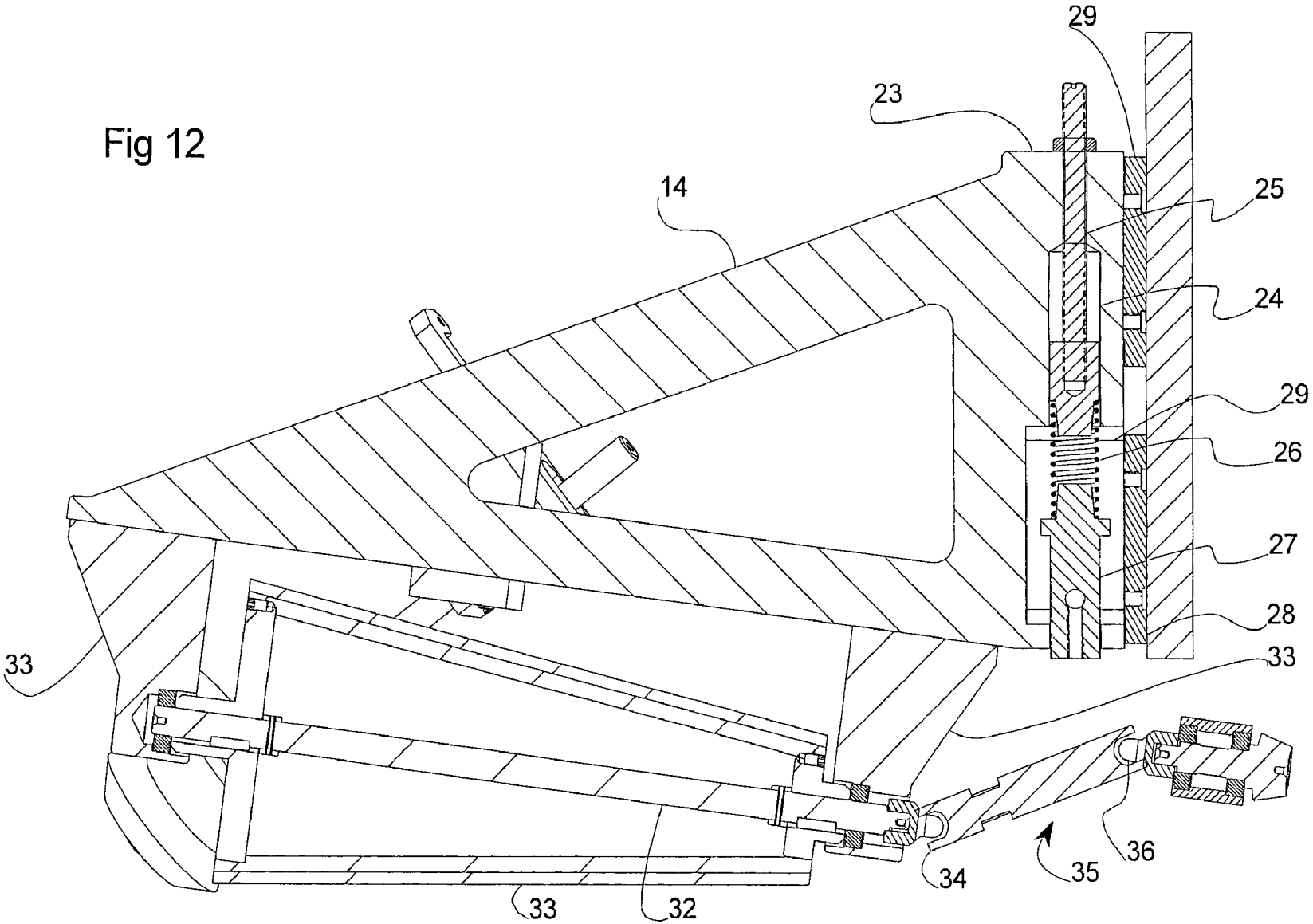
FIG. 12 is a sectional view of the roller assembly.

The five clamp roller assemblies 6 are provided to prevent the pipe trying to recover from the spiral pattern in which it is laid to a less arcuate form. As shown in detail in FIG. 10 each roller assembly 6 comprises a triangular roller support frame 21 having a radially inner mounting flange 22 for mounting the roller assembly onto the main shaft 2 and a roller suspension flange 23.

The mounting flange 23 includes a box section defining an elongate suspension chamber 24. A suspension rod 25 is slidably received into the chamber 24 and supports a helical spring 26 at its base end. The helical spring joins the suspension rod 25 to a bearing rod 27 which projects through a closely fitting passage 28 in the roller suspension flange 23. A pair of mounting brackets 29 are bolted one above the other to the mounting flange 23. Each mounting bracket 29 is provided with opposing "U" sections along each vertical edge adapted to slidably engage around a mounting rail 30 which is bolted to extend vertically up the side of the main shaft 3 above an annular mounting flange 10*a* formed on the elongate support member 10 of the traverse assembly, and by means of which the traverse assembly is attached to the main shaft 3. Thus the roller assembly can slide up and down the mounting rail 30 and is borne via the spring 26 on the mounting flange 10*a*. This ensures that there is a reasonable degree of give to the roller assembly to prevent the weight of the roller damaging the pipe P. When mounted the roller mounting flange extends radially out from the main shaft 3.

The roller 31 is of conic shape and splined onto a roller axle 32 with the narrow end mounted radially innermost. The roller axle 32 is mounted in bearings supported by brackets 33 which are bolted to depend from the roller suspension flange 23. It will be noted that the roller axle 32 is inclined upwards from the main shaft so that the lowermost surface of the roller 31 extends horizontally where it bears against the laid pipe P.

The roller surface is covered by a soft resilient foam 33 able to readily conform to the shape of the pipe and so disperse the weight of the roller assembly and avoid damage to the pipe while preventing any radial movement of the pipe.

The roller axle 32 is coupled to be driven in rotation by a flexible telescopic transmission comprising; a first universal joint 34, a telescopic drive shaft 35, a second universal joint 36 and a spur gear shaft 37. The transmission couples the roller axle to a sun drive gear 38 provided axially underneath the main shaft 3. The sun drive gear 38 is coupled via a shaft through the base of the hollow main shaft 3 to a sun and planetary gear system 39. The planetary gear of this system is driven via a sub drive shaft 40, which extends vertically in a channel formed in the outside of the main shaft 3 to couple by means of a planetary gear 40*a* with an orbital gear 41 in an annular transmission 42 mounted on the top of the main shaft 3. The orbital gear 41 is bolted to a housing of the annular transmission which is mounted onto the main frame of the spiral winder. Thus as the main shaft 3 rotates, driven by a shaft drive motor 43, the orbital gear 41 rotates against the planetary gear 40*a* to drive the rollers in rotation according to the speed of rotation of the main shaft 3. A small alteration in this speed can be made by actuating servos which cause the orbital gear 41 to rotate relative to the transmission housing in either the clockwise or anticlockwise direction so that the speed of the roller 31 can be advanced or retarded.

The conic angle of the roller 31 is selected so that although the angular speed of the axle 32 matches that of the main shaft 3 the linear speed of the bottom roller surface where it bears on the pipe matches the linear speed of the axle over the surface at that radius (subject to the aforementioned adjustment).

It will be realised from the provision of the clamp roller assemblies 6 that to allow a new layer of pipe to begin coiling it is necessary to drop the platform sufficiently far as to leave a gap between the top surface of the laid layer of pipe and the bottom of the rollers sufficient to allow for the unobstructed introduction of a new layer of pipe and then raising the platform a smaller distance so that the bottom of the rollers bears on the top of the pipe being laid.

At the innermost locus of the spiral the natural tendency of the pipe to expand radially means there is no problem with forming a climbing loop to bridge between the laid and the next layer. However, this is not the case with the outermost locus where the bridging layer is inclined to fall down the outside locus of the coil. To prevent this happening each roller assembly is provided with a grooved pulley wheel 44 rotatably mounted on a shaft 45 to trail behind the outer end of the roller 31. The shaft 45 extends radially with respect to the main shaft 3 and is mounted on the roller support frame 21 by means of a pivot 46 to pivot about a tangent to the axis so that the outer climbing loop of pipe engages in the groove of the pulley wheel 44 and is retained until the next layer of pipe is established and retained by the rollers. As the climbing loop is established and the rollers reengage the pipe the speed of the rollers may usefully be altered by advancing or retarding the orbital gear 41 in order to slightly tension the climbing loop and encouraging the climbing loop to bind against the coil.

Figure 13:
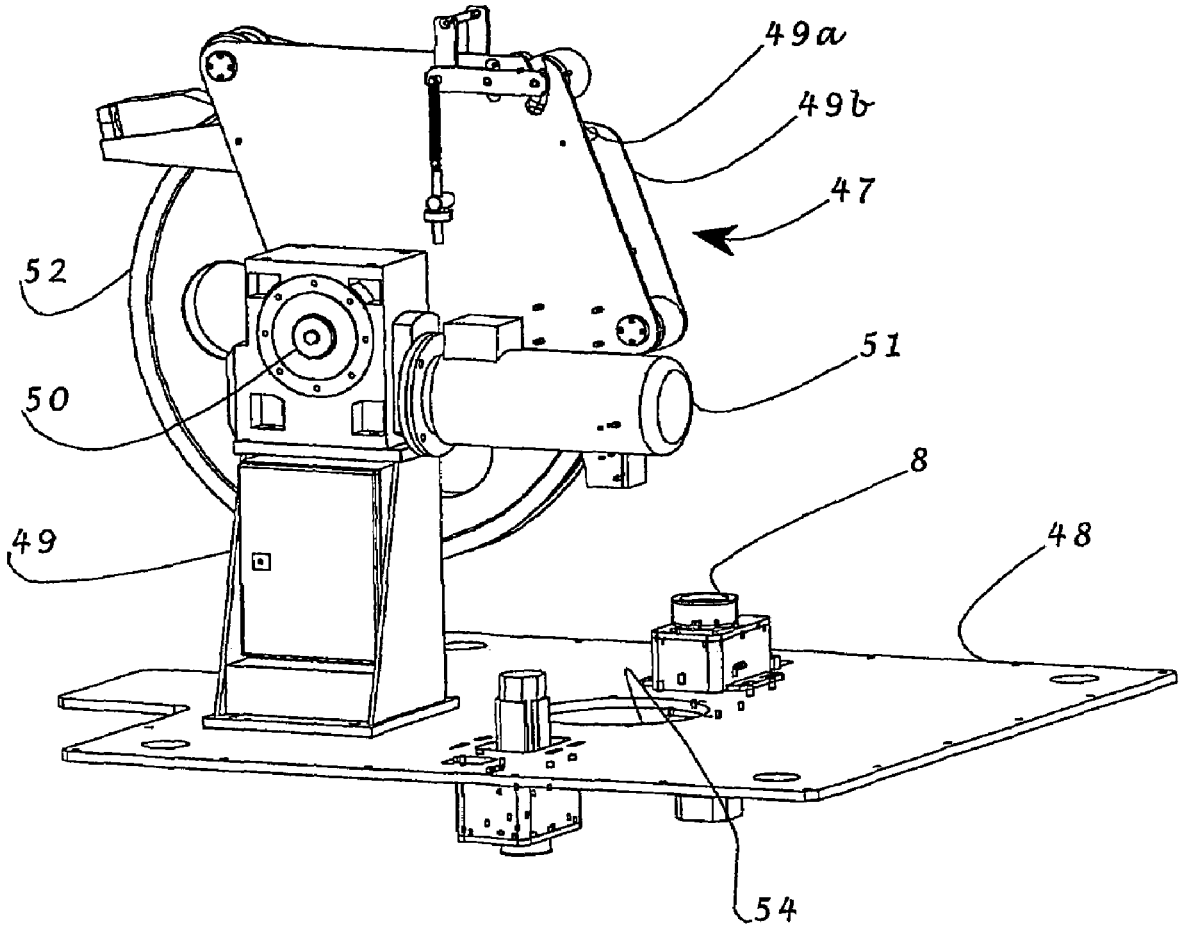
FIG. 13 is a perspective view of a capstan
Figure 14:
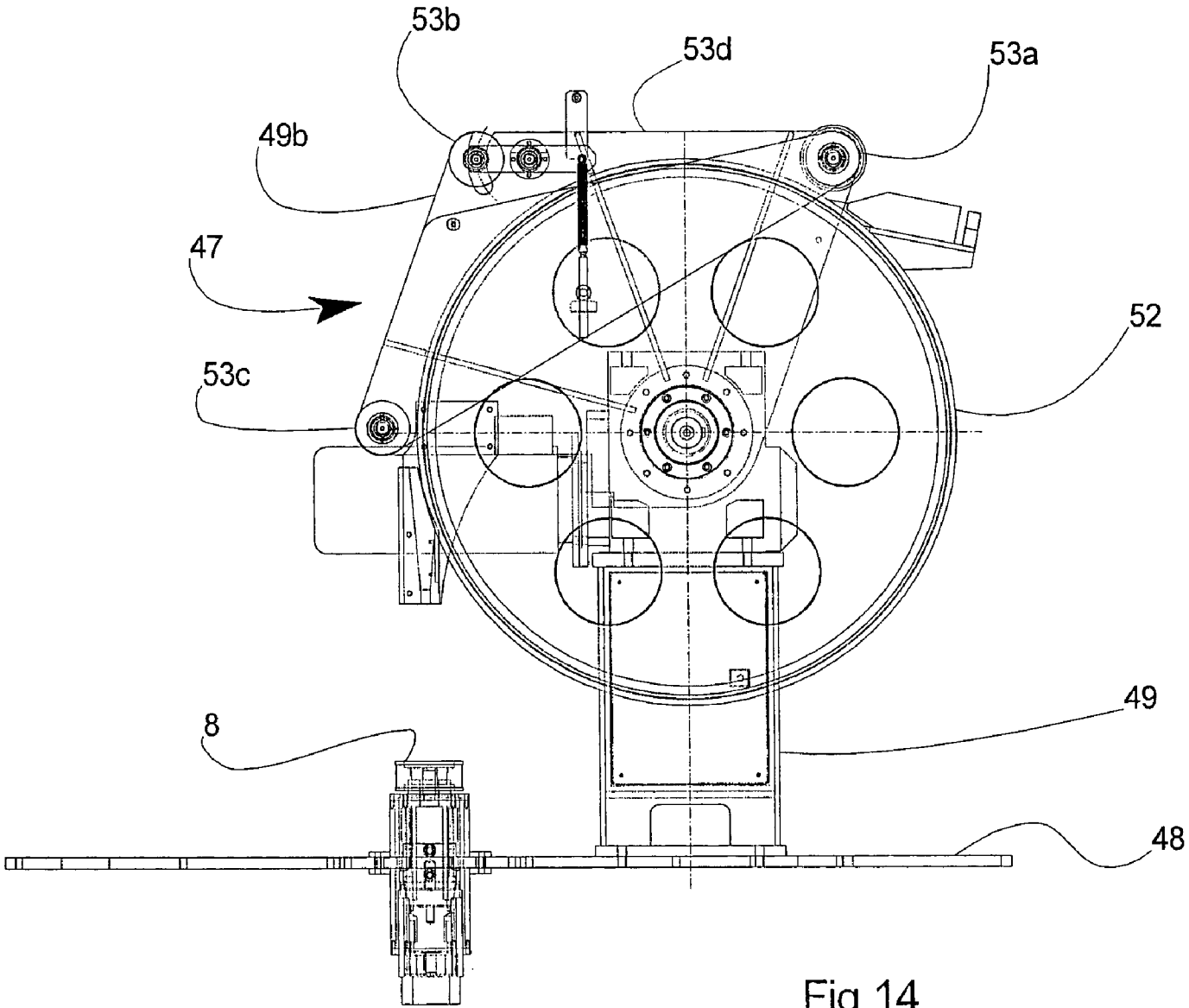
FIG. 14 is a side elevation of the capstan

As has previously been implied, the success of the machine depends greatly on controlling the tensile or compressive forces acting on the pipe as it is laid. This is also true at the introduction of the pipe to the caster inlet. To achieve control of these forces the pipe is introduced to the caster inlet by means of a capstan assembly 47 which can best be seen in most detail in FIGS. 13, 14 and 15.

The capstan assembly 47 is mounted on a floor panel 48 forming part of the main frame overlying the rotor assembly 1. It comprises a support structure 49 which supports a horizontally extending drive shaft 50 and a transmission coupling the drive shaft 50 to a drive motor 51. The drive shaft 50 mounts a main grooved pulley 52 for rotation. The support structure includes opposing support plates 49*a*, 49*b* which support three guide rollers 53. The guide rollers 53*a*, 53*b* and 53*c* support an endless belt 53*d* the span of the belt extending between the rollers 53*a* and 53*c* wraps around segment of the main pulley 52 so that a length of the pipe P can be trapped between the belt 53*d* and the pulley 52 and so can be drawn up from an accumulator assembly and into the inlet 8 of the caster 7. The capstan pulley 52 is rotated at a speed controlled by the control system in response to the speed of the rotor in order to accurately manage the tension and compression on the pipe.

Figure 15:
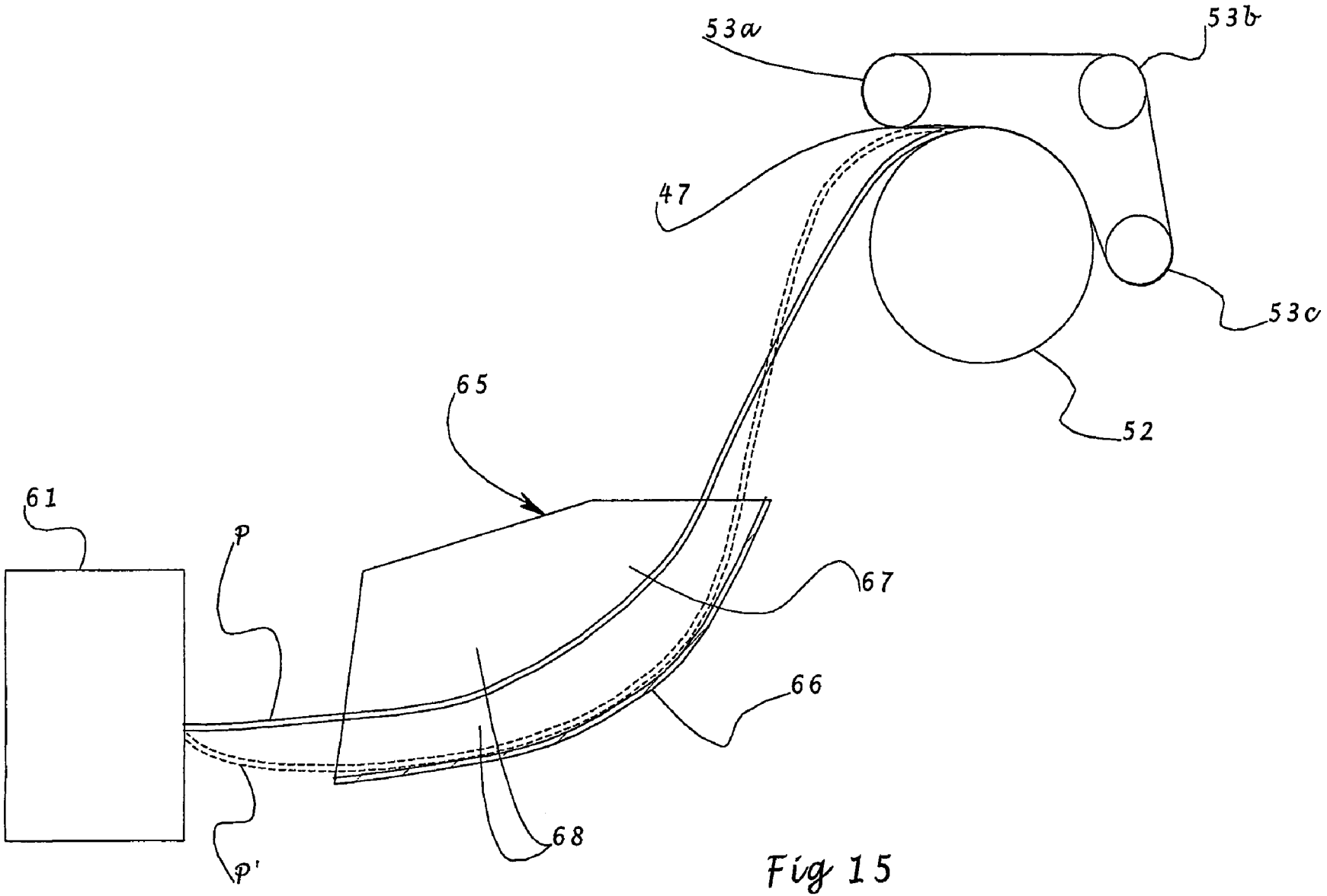
FIG. 15 is side elevation of an accumulator.

The accumulator assembly comprises an arcuate trough 65 shown in section in FIG. 15. The trough has a base panel 66 which arcs from a horizontal to an upwardly inclined condition and upstanding side walls 67. There are no end walls. As the end of a pipe P exits a diverter 61 it droops to the floor of the trough 65 and is guided by the floor and side walls up along the path illustrated by dotted line P' into the capstan 47 and hence around the capstan and into the caster inlet 8. Thus the trough 65 serves to automatically feed the pipe end to the capstan. Once the pipe is fully engaged by the capstan it is desirable that some slack is made available upstream of the capstan so that the capstan can implement changes to the pipe compression or tension and so the pipe is wound on by the spiral winder so that some tension exists in the span of pipe between the diverter and capstan forming a catenary as illustrated by P. The control unit adjusts the spiral winder speed in response to any change in the arc or the catenary sensed by catenary position sensors 68. The slack provided by the catenary allows the capstan assembly to alter the pipe compression or tension downstream in the rotor independently of the pipe production line upstream.

Figure 16:
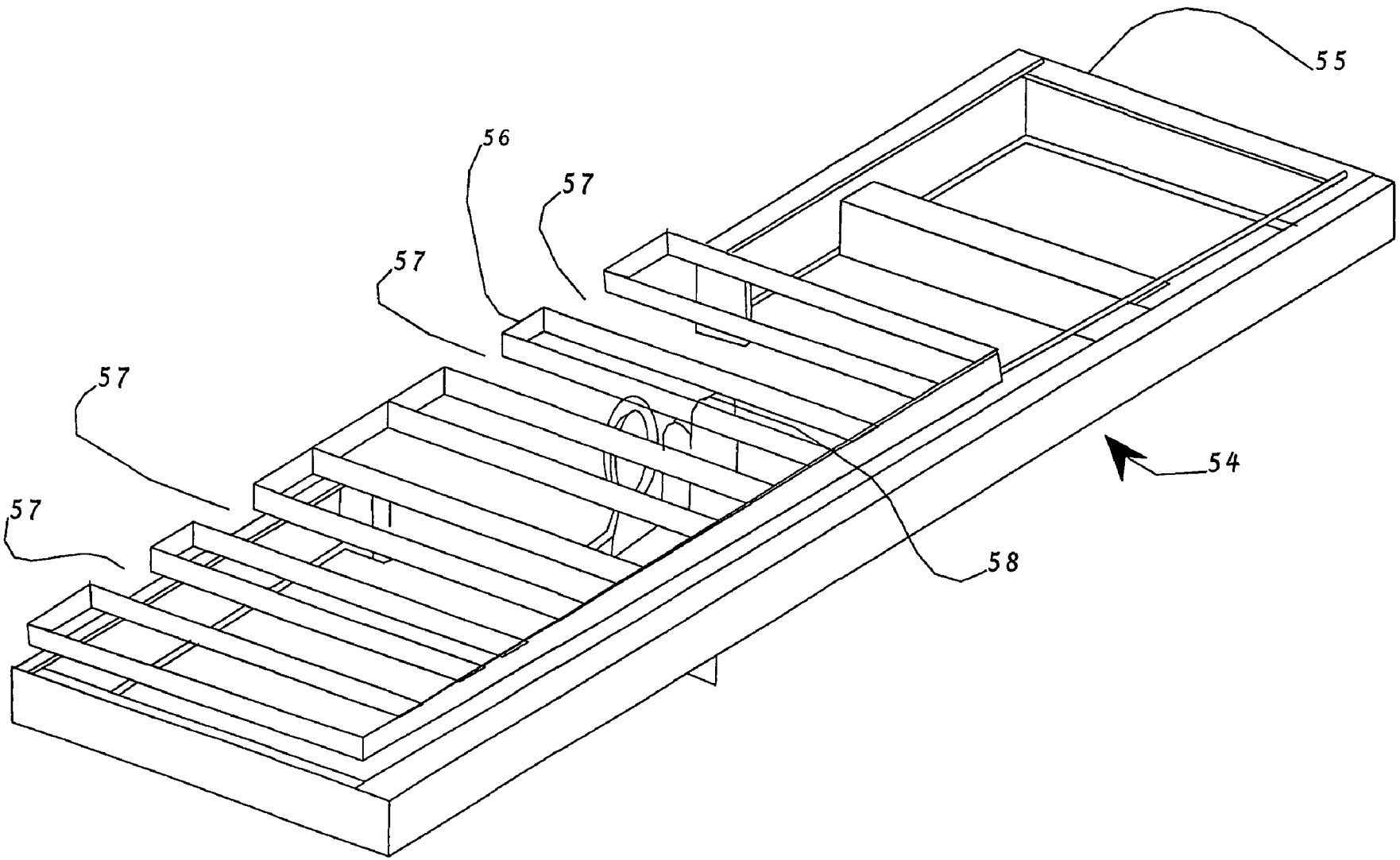
FIG. 16 is a perspective view of a transfer table assembly

When a coil approaches the desired size it is necessary to cut the pipe and the cut end is wound into the coil. The coil is formed directly onto a pallet and so it is convenient to simply place a spacer on top of the coil and commence winding a second or third coil on top forming a stack of coils on the one pallet. However, when the desired number of coils are wound onto the pallet the pallet is lowered by the fork lift 14 until it rests on a transfer table 54 shown in detail in FIG. 16 and in combination with the spiral winder in FIG. 6. The transfer table consists of a rectangular frame 55 supported on the ground. The long sides of the frame extend laterally to each side of the main frame 3 of the spiral winder and provide guide rails for wheels of a trolley 56 which extends two thirds of the length of the transfer table 54. The trolley 56 comprises a frame which is able to provide support for a pallet and has apertures 57 provided to receive the forks of the fork lift 14. It may be noted that the forks of the fork lift 14 are adapted by means of raised sections 69 so that these sections lie flush with the guide rails when the forks are lowered to allow the trolley wheels to pass smoothly over the forks. In use a pallet is placed onto the end of the trolley 56 at an end of the frame 55. The fork lift 14 lowers a pallet bearing coils onto the other end of the trolley 57. The trolley is then moved to the other end of the frame by means of the trolley motor drive 58 bringing the empty pallet to the centre of the transfer table under the spiral plane. The fork lift 14 then lifts the empty pallet into position to commence winding a new coil. While the new coil is being wound the loaded pallet is removed from the trolley by a conventional fork lift truck and transported to storage.

Figure 17:
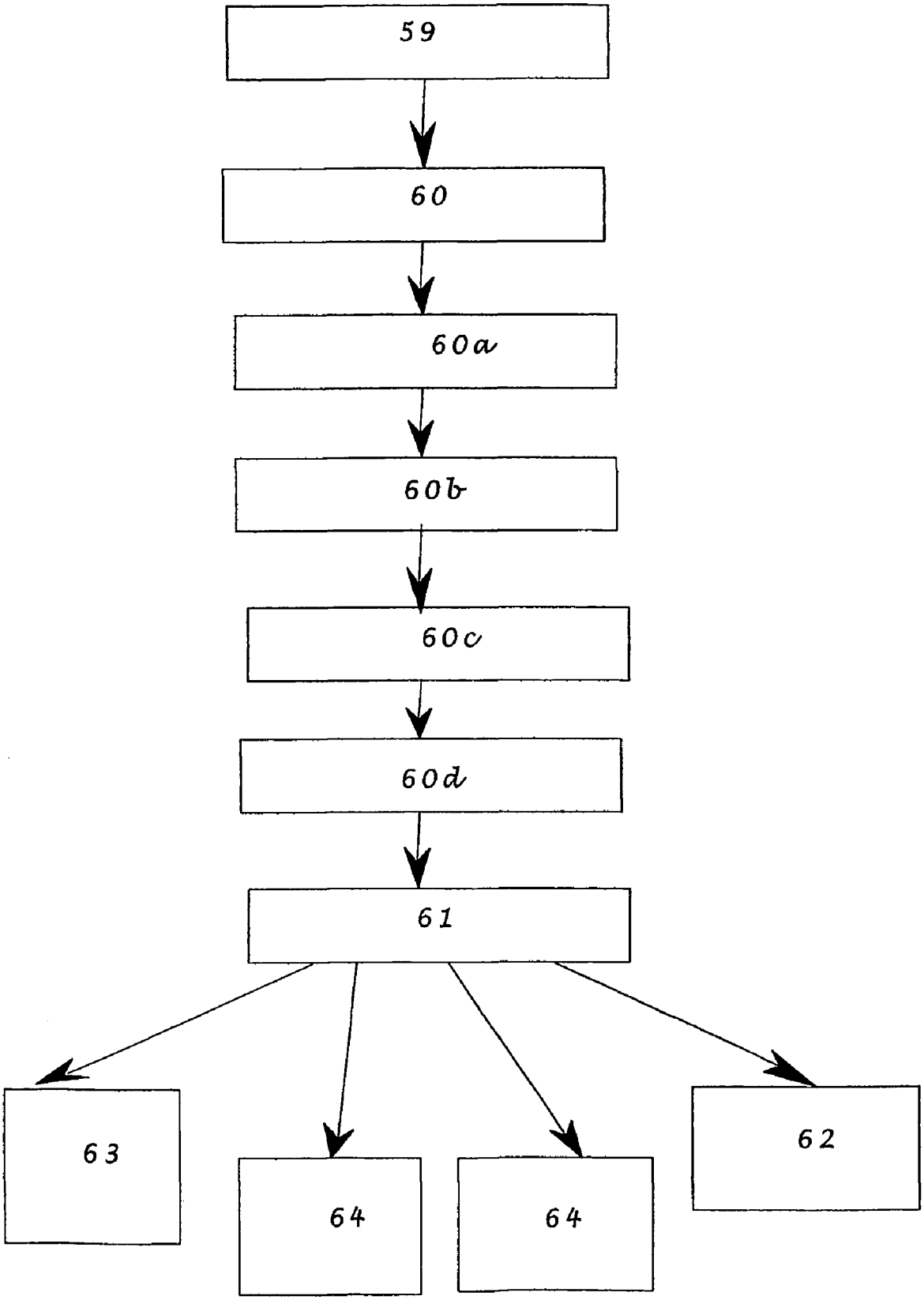
FIG. 17 is a diagram illustrating apparatus for manufacturing a spirally wound coil of pipe.

FIG. 17 illustrates the spiral winder in combination with apparatus for forming a pipe. This consists basically of feedstock comprising a coil of strip which is delivered to a decoiler 59. The strip is fed to a rolling mill 60 where it is rolled into tube. The tube then passes to a welder 60*a* which welds the seam together forming pipe. The pipe is then annealed at an in line annealing station 60*b*. The annealing station may be provided by any mechanism able to continuously heat an elongate material travelling in the direction of its length to a suitable annealing temperature for a desired period. This may then comprise gas burners, electric heaters, or inductive heating. In line annealing is the first notable difference from conventional pipe forming lines where annealing does not take place until the pipe has been coiled. This has numerous benefits both in production costs and speed and in the problems associated with end use of the product. For example, the annealing station can be relatively small and energy efficient needing only to heat the pipe. The pipe is annealed and cooled in a substantially straight condition and so even after coiling in the winder and decoiling by the end user the pipe is inclined to relax to a straight condition whereas annealing in the coiled condition produces pipe inclined to an arcuate condition. The pipe passes downstream from the annealer 60*b* to a cooling station 60*c*. The cooling station may consist of air blast cooling water or other coolant spray mechanisms controllable to cool the pipe at an appropriate rate to produce the desired pipe properties.

Downstream of the cooling station is a non-destructive testing station (NDT station) 60*d*. Here the pipe is continuously examined for imperfections using instrumentation such as magnetic field sensors, acoustic sensors, optical sensors, or electric field sensors. Such sensor devices are well known in the art.

From the NDT station 60*d* the pipe passes to a diverter 61. The diverter 61 is capable of diverting the path of the pipe to any one of four paths namely, to a test tray 62 where a sample of pipe can be delivered for destructive testing once it has passed the non-destructive tests at the station 60*d*. While the pipe sample is being subject to testing at the test tray 62 the pipe, which is still being produced is diverted to a shredder 63 where it is shredded for disposal. When the pipe passes the destructive testing the diverter switches the pipe path to one of a first spiral winder 64' or a second spiral winder 64" where the tested and finished pipe is wound as previously described. Two spiral winders 64 are employed to minimise wastage when a coil is completed. Thus as a coil nears the desired size the pipe is cut by the diverter and simultaneously diverted to the other of the spiral winders where a new coil begins to wind. The pallet on which the completed coil sits may then be removed or a separator laid on top to receive a new coil on the stack.

The invention claimed is:

1. A spiral winder for spirally winding a coil of pipe comprising a rotor assembly supported to rotate about a vertical axis and having a continuous resilient tube caster adapted to receive the pipe into an inlet and to support and guide the pipe to an outlet and a traverse assembly to support said outlet to travel in a spiral orbit in a spiral plane about the axis whereby the pipe can be inducted into a caster inlet and induced to travel through the caster to the outlet where it can be discharged in the spiral plane onto a platform in a planar spiral pattern.

2. A spiral winder according to claim 1 further comprising a support assembly which includes a lift assembly to engage and lift the plafform towards and away from the spiral plane.

3. A spiral winder according to claim 2 wherein a transfer table assembly is provided to transfer an unloaded platform to the lift assembly and simultaneously to transfer a plafform away from the lift assembly.

4. A spiral winder according to claim 1 wherein the traverse assembly is rotatably supported by a hollow main shaft and the caster extends helically down from the axis at the top of the main shaft.

5. A spiral winder according to claim 4 wherein the traverse assembly comprises a track extending radially from the main shaft to guide a carnage for carrying the caster outlet radially in and out.

6. A spiral winder according to claim 4 wherein the traverse assembly provides a carriage propulsion mechanism whereby the radial speed and direction of travel of the carriage can be controlled.

7. A spiral winder according to claim 1 having a support assembly to support the rotor assembly and the platform whereby the distance between the spiral plane and the platform can be increased so that when a first layer of pipe has been laid on the platform and the caster outlet reaches the inner or outer locus of the spiral a next layer of the pipe can be laid onto a former layer of the pipe.

8. A spiral winder according to claim 7 wherein the spiral plane is kept substantially stationary and the platform is moved away from the spiral plane.

9. A spiral winder according claim 1 wherein the rotor assembly includes a clamp roller assembly comprising a clamp roller rotatable about a roller axis and mounted so that the roller axis extends radially from and is rotatable around the vertical axis above the spiral plane whereby the periphery of the roller can bear on the pipe as it is laid on the platform.

10. A spiral winder according to claim 9 wherein the roller has a conic rolling surface configured so that a roller surface speed at any given radius from the vertical axis matches a roller traverse speed at which the axis of the roller at that radius traverses the platform at that radius from the vertical.

11. A spiral winder according to claim 9 wherein the roller surface is resiliently deformable.

12. A spiral winder according to claim 9 wherein the roller is coupled to a rotary drive whereby the roller is forced to rotate about the roller axis.

13. A spiral winder according to claim 12 wherein the rotary drive is adapted to enable a roller peripheral speed to be controlled to a speed faster, slower or the same as the traverse speed during winding.

14. A spiral winder according to claim 9 wherein the roller assembly is mounted onto a main shaft to be vertically displaceable with respect to the main shaft.

15. A spiral winder according to claim 14 wherein the roller assembly is mounted via a resilient suspension.

16. A spiral winder according to claim 9 wherein the roller assembly includes a peripheral retaining pulley supported to engage an outermost loop of a pipe winding as the distance of the platform from the spiral plane is increased.

17. A spiral winder according to claim 9 wherein five angularly spaced roller assemblies are mounted for rotation about a main shaft.

18. A spiral winder according to claim 1 wherein the pipe is fed to the caster by a capstan.

19. A spiral winder according to claim 18 wherein the capstan is driven by a motor at a speed responsive to a speed of the caster outlet.

20. A spiral winder according to claim 19 having an accumulator assembly upstream of the capstan which allows slack to be taken up or to be generated by the capstan so that a capstan speed can be controlled in response to control signals from the control unit to increase or decrease tension or compression in the pipe within the caster.

21. A spiral winder according to claim 1 wherein the caster comprises a helical duct and the inlet is disposed on the axis of rotation such that the pipe is guided into the inlet along the axis of rotation.

22. A method of spirally winding a pipe comprising the steps of introducing a pipe into an inlet of a caster rotating on a main axis of a rotor of a spiral winder; and orbiting an outlet of the caster around the main axis in a spiral pattern lying in a spiral plane in order to discharge the pipe onto a platform in the spiral pattern.

23. A method of spirally winding a pipe according to claim 22 comprising the step of pressing on the pipe laid in the spiral pattern to retain the spiral pattern of the pipe as laid.

24. A method of spirally winding a pipe according to claim 23 comprising the step of pressing on the laid pipe by means of a roller assembly which comprises at least one roller on a roller axis rotated about the main axis at a speed similar to that of the caster outlet.

25. A method of spirally winding a pipe according to claim 24 comprising the step of driving the rotation of the roller about the roller axis at a speed controlled to adjust the amount of tension or compression in the laid pipe.

26. A method of spirally winding a pipe according to claim 24 comprising the step of controlling the force with which the roller assembly presses on the laid pipe.

27. A method of spirally winding a pipe according to claim 23 comprising the steps of laying a last loop of pipe at an outer locus of one spiral layer, laying a climbing loop of pipe as the platform is moved away from the spiral plane, and laying an outermost loop of an overlying layer of pipe, and engaging and holding the climbing loop of pipe as the outermost loop is laid in the overlying layer.

28. A method of spirally winding a pipe according to claim 27 comprising the step of applying tension to the climbing loop of pipe so that the climbing loop binds against the outermost loop of each of the underlying and overlying layers.

29. A method of spirally winding a pipe according to claim 22 comprising the step of increasing a distance between the platform and the spiral plane when the orbit of the caster outlet reaches an inner annular locus or an outer annular locus and reversing a direction of radial travel of the caster outlet to lay an overlying spiral layer of pipe onto an underlying layer of pipe.

30. A method of spirally winding a pipe according to claim 29 wherein the step of increasing the distance comprises the steps of first increasing the distance by a large amount to exceed a desired gap between the spiral plane and the platform and then reducing the distance to set the desired gap between the spiral plane and the platform.

31. A method of spirally winding a pipe according to claim 29 comprising the step of keeping the spiral plane stationary and moving the platform to increase the distance between the spiral plane and the platform.

32. A method of spirally winding a pipe according to claim 22 comprising the step of feeding the pipe to the inlet of the caster by means of a capstan assembly speed controlled to control the tensile and compressive forces on the pipe entering the caster inlet.

33. A method of spirally winding a pipe according to claim 22 wherein a coil is formed, comprising the steps of:

cutting the pipe, winding a cut end of the pipe into the coil, laying a separator onto the coil to act as a new platform; and winding another coil onto the separator.

34. A method of spirally winding a pipe according to claim 22 wherein a coil is formed, comprising the steps of:

cutting the pipe, completing winding the coil, displacing the platform bearing the coil from beneath the rotor and moving a new platform into place beneath the rotor ready for a new coil to be wound.

35. A method of spirally winding a pipe according to claim 34 comprising the step of providing the platform by means of a pallet.

* * * * *